US007170033B2

(12) United States Patent
Kaesler

(10) Patent No.: US 7,170,033 B2
(45) Date of Patent: Jan. 30, 2007

(54) HEATED MAT ASSEMBLY AND METHOD FOR MANUFACTURING SAME

(76) Inventor: Arthur Kaesler, 2085 Gilbride Rd., Martinsville, NJ (US) 08836

( * ) Notice: Subject to any disclaimer, the term of this patent is extended or adjusted under 35 U.S.C. 154(b) by 0 days.

(21) Appl. No.: 10/814,709

(22) Filed: Mar. 31, 2004

(65) Prior Publication Data

US 2004/0195234 A1 Oct. 7, 2004

Related U.S. Application Data

(60) Provisional application No. 60/461,025, filed on Apr. 4, 2003.

(51) Int. Cl.
*H05B 1/00* (2006.01)

(52) U.S. Cl. ..... 219/201; 219/528; 219/544; 219/549

(58) Field of Classification Search ..... 219/201, 219/213, 528, 543, 548, 544, 549; 156/583.2; 29/611

See application file for complete search history.

(56) References Cited

U.S. PATENT DOCUMENTS

| | | | | |
|---|---|---|---|---|
| 2,714,416 | A * | 8/1955 | Fener | 156/583.2 |
| 3,495,328 | A * | 2/1970 | Ziver | 29/611 |
| 4,661,689 | A * | 4/1987 | Harrison | 219/528 |
| 5,380,988 | A * | 1/1995 | Dyer | 219/548 |
| 5,925,275 | A * | 7/1999 | Lawson et al. | 219/543 |

* cited by examiner

*Primary Examiner*—Robin Evans

*Assistant Examiner*—Leonid M. Fastovsky

(57) ABSTRACT

A heating mat employs electrical resistance foils to provide a uniform heat. In embodiments of the invention applicable for providing heat to individuals, the mat provides this uniform heat at a comfortable temperature. The heating mat structure comprises protective layers surrounding the heating element to provide a durable structure that is suitable for industrial and commercial use.

12 Claims, 4 Drawing Sheets

HEATED MAT ASSEMBLY AND METHOD FOR MANUFACTURING SAME

CROSS-REFERENCE TO RELATED APPLICATIONS

This application claims the benefit from U.S. Provisional Application Ser. No. 60/461,025 filed Apr. 4, 2003 entitled "Heated Mat Assembly and Method for Manufacturing Same", which is specifically incorporated herein by reference for all that it discloses and teaches.

FIELD OF THE INVENTION

The present invention relates to electrically powered heating mats, and more particularly to mats used to supply an even heat source to individuals.

BACKGROUND OF THE INVENTION

Electrically powered mat-like devices have long been known and used for generating heat for various purposes, and through the course of their development such devices have become quite sophisticated and specialized for particular purposes. The present invention provides a new member of this class of device that is particularly adapted for use for providing a uniform heating source.

The configurational embodiment of heated mats is critical to their practical utility and has not been well addressed by prior devices. Such a mat should be relatively thin to not significantly interfere with the activities of the users. That is, for use in an area in which one stands or sits, the thickness should not create a safety problem by creating a potential for tripping or twisting one's ankle. Further, the mat should be particularly resilient to wear in such an environment where foot traffic and/or chair movement is concentrated on sections of the mat surface. Moreover, where such activity does eventually cause wear in the surface of the mat, visual cues should be provided when that wear has occurred to the point where it potentially causes a problem with the electrical integrity of the mat. The mat should be sufficiently durable to withstand damage which may occur from users wearing stiletto shoes or high heels, or from accidentally dropping a heavy or sharp object. And perhaps most importantly, the mat should be so constructed that the individual user is protected from electrical shock should the electrical circuit of the mat be damaged.

Functionally prior mats have experienced difficulties in providing uniform heat over the entire mat surface and in providing such uniform heat at a temperature comfortable to individual users.

The present invention overcomes these shortcomings of the prior art by providing a heating mat structure which comprises a heating element that is formed of electrically resistive foil that is contained in protective layers of chopped strands and resins. Additional embodiments of the invention further comprise an aluminum earth screen. As an additional safety feature, a color indication is presented to the user should significant wear of the top surface occur.

SUMMARY OF THE INVENTION

The heating mat structure of the present invention employs electrical resistance foils to provide a uniform heat. In embodiments of the invention applicable for providing heat to individuals, the mat provides this uniform heat at a comfortable temperature. This structure comprises protective layers surrounding the heating element to provide a durable structure that is suitable for industrial and commercial use.

BRIEF DESCRIPTION OF THE DRAWINGS

Various embodiments of the present invention will now be described in detail in conjunction with the annexed drawings, in which.

DETAILED DESCRIPTION

The present invention is an electrically powered heating mat. In one embodiment of the invention this mat is an individualized fiberglass reinforced polyester (FRP) heater for the feet and lower body for personnel in cold locations—that is, the heater provides warmth for the feet and lower body on an individualized basis. The heater relies on an alternative current voltage being applied to electrical resistance foils that are in a series/parallel configuration in the heating mat. Such an embodiment of the invention is depicted in FIGS. 1*a* and 1*b*.

Figures 1A, 1B:
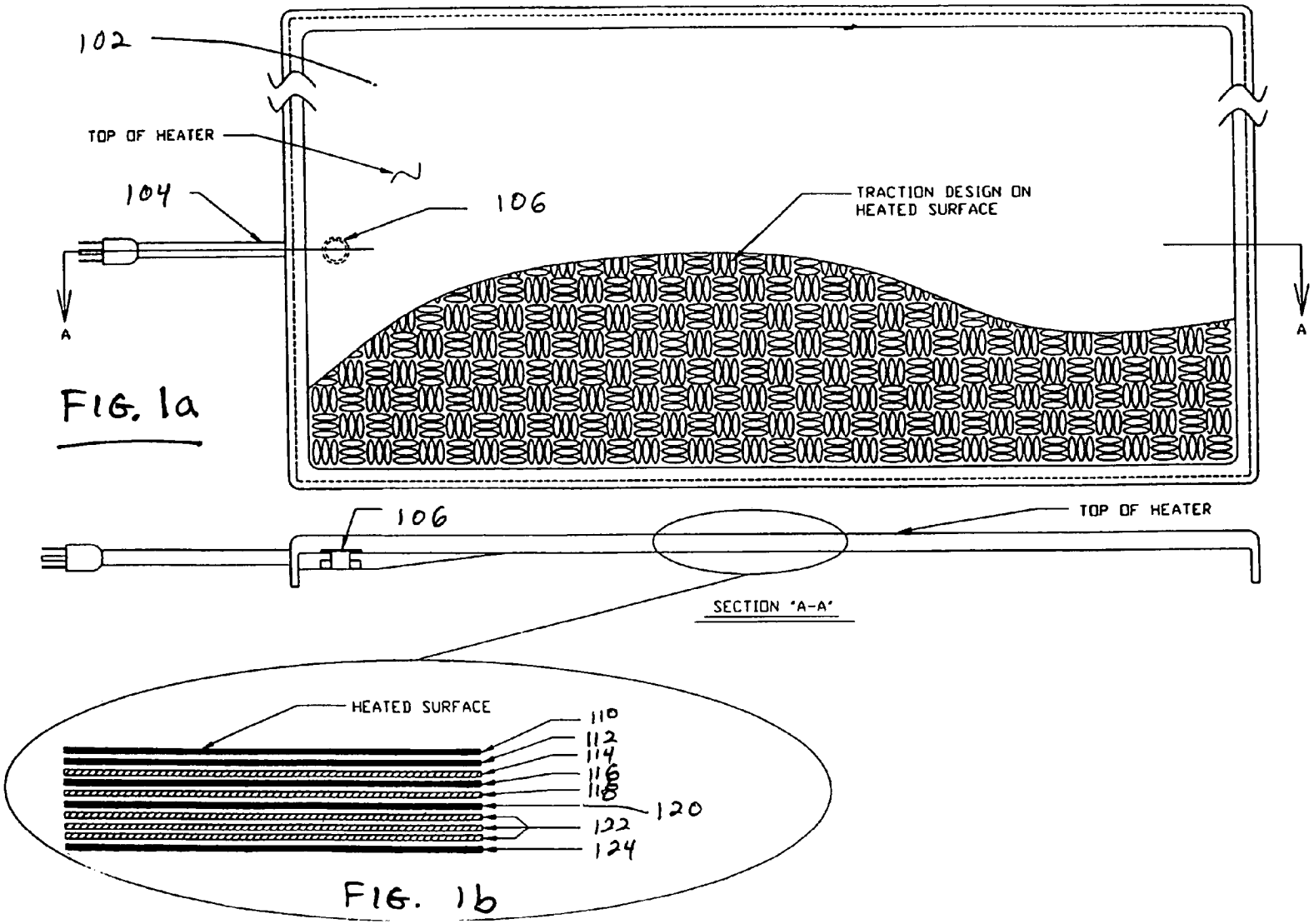
FIG. 1*a* is perspective top surface view showing the overall appearance of the heating mat according to one embodiment of the invention.
FIG. 1*b* is a partially cut-away view of the embodiment of the invention depicted in FIG. 1*a;*

As illustrated in FIG. 1*a,* an 8' flexible cord 104, fitted with a 3-prong plug, supplies power to the heating mat 102. A thermal cut out switch 106 is built into the heater to preclude overheating. In the depicted embodiment the heater will draw approximately 30 Watts/square foot. In a further embodiment, the heating mat 102 is approximately 24"×18". Additional embodiments with various other dimensions are contemplated.

As depicted in FIG. 1*b,* the invention consists of a layered structure comprising a heating element 120. In additional embodiments, this heating element comprises nichrome or cupro-nickel foil resistance elements of width not greater than 0.125" and thickness not greater than 0.005". In another additional embodiment the nichrome element is an 80/20 ratio of nickel to chrome.

In a further embodiment the heating element 120 comprises foil elements that are sewn between two layers of fiberglass cloth to form a blanket. In a preferred embodiment each such fiberglass layer is approximately 0.01" in thickness and the sewing procedure creates pockets in which the foil elements reside. Thus in the manufacturing of such a blanket, the foil elements are not damaged by the sewing procedure. In one embodiment of the invention it is envisioned that rows of such pockets would be created, such rows spaced approximately 0.125" apart. It is further contemplated that the mechanism for creating this blanket would create 20 such pockets per pass.

In the embodiment depicted in FIG. 1*b,* an aluminum earth screen 116 is positioned above a chopped strand fiberglass mat 118, which fiberglass mat 118 positioned directly above the heating element 120. This aluminum earth screen 116 element provides an important safety feature of the invention in that should the top surface of the heating mat 102 be penetrated, the earth screen becomes effective and as it touches the heating foils of the heating element 120. It thereby gives a ground fault to trip off the voltage.

Additional safety features contained in various embodiments of the invention include a traction surface design on the top mat surface. This top surface consists of a colored gell coat layer 110. When this top gell coat layer 110 wears away, a contrasting color (contained on layer 112) is then visible to the user to indicate that the outer face is worn and the heater should be replaced. By way of example, the top of the heating mat would be black and as this top layer sufficiently wears, it will show an underlying red color. Accordingly, this functions as a color warning indicator that the heating mat should be replaced.

In additional embodiments of the invention a flame retardant polyester flow coat resin, which as a liquid is enriched with antimony trioxide, or similar material, is used in one or more layers 124. Further, one or more layers 122 of a roving glass fiber mesh are utilized thereby providing reinforcing strength. That is, the random position of the glass fibers in this manner adds significantly to the structural stability of the mat. The resulting heating mat has excellent abrasion qualities and high compressive and tensile strengths. Further, the mat will not break down even under a 5 KV high pot test.

Figures 2A, 2B:
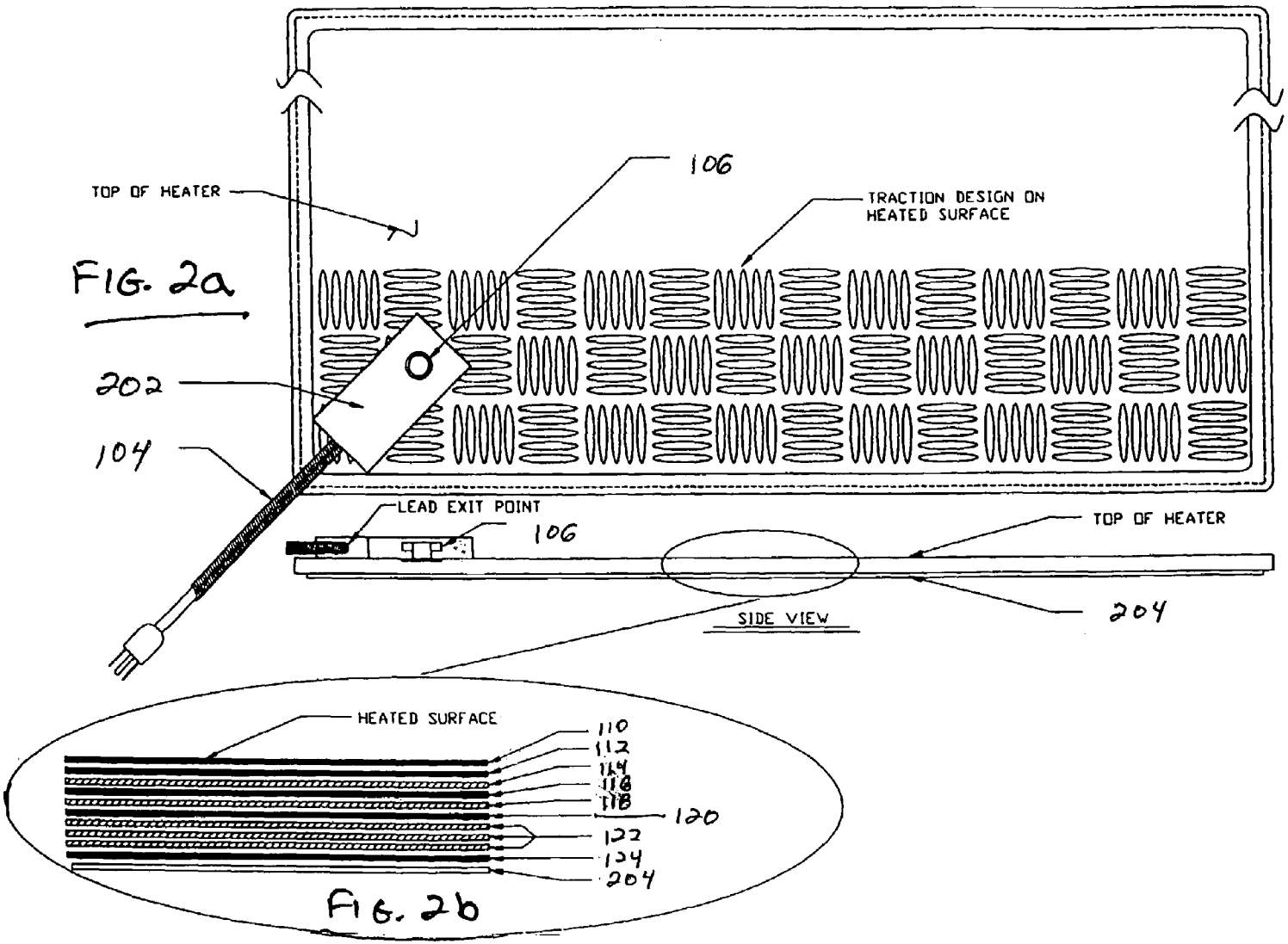
FIG. 2*a* is perspective top surface view showing the overall appearance of the heating mat according to a second embodiment of the invention.
FIG. 2*b* is a partially cut-away view of the embodiment of the invention depicted in FIG. 2*a;*

FIGS. 2*a* and 2*b* show an additional embodiment of the invention in which is contemplated for use in a standard size of 24"×24" and capable of functioning with a 120, 240 or 480 voltage power source. Such a configuration would draw approximately 25–35 Watts/sq. ft. In the embodiment depicted in FIG. 2*a* a junction box 202 is molded onto the exterior of the heating mat. As illustrated, this junction box contains the thermostat cut-out and provides the means for connecting the power cord to the heating mat. Further, as depicted, a rubber padding is added to the bottommost layer 204.

Figures 3A, 3B, 3C:
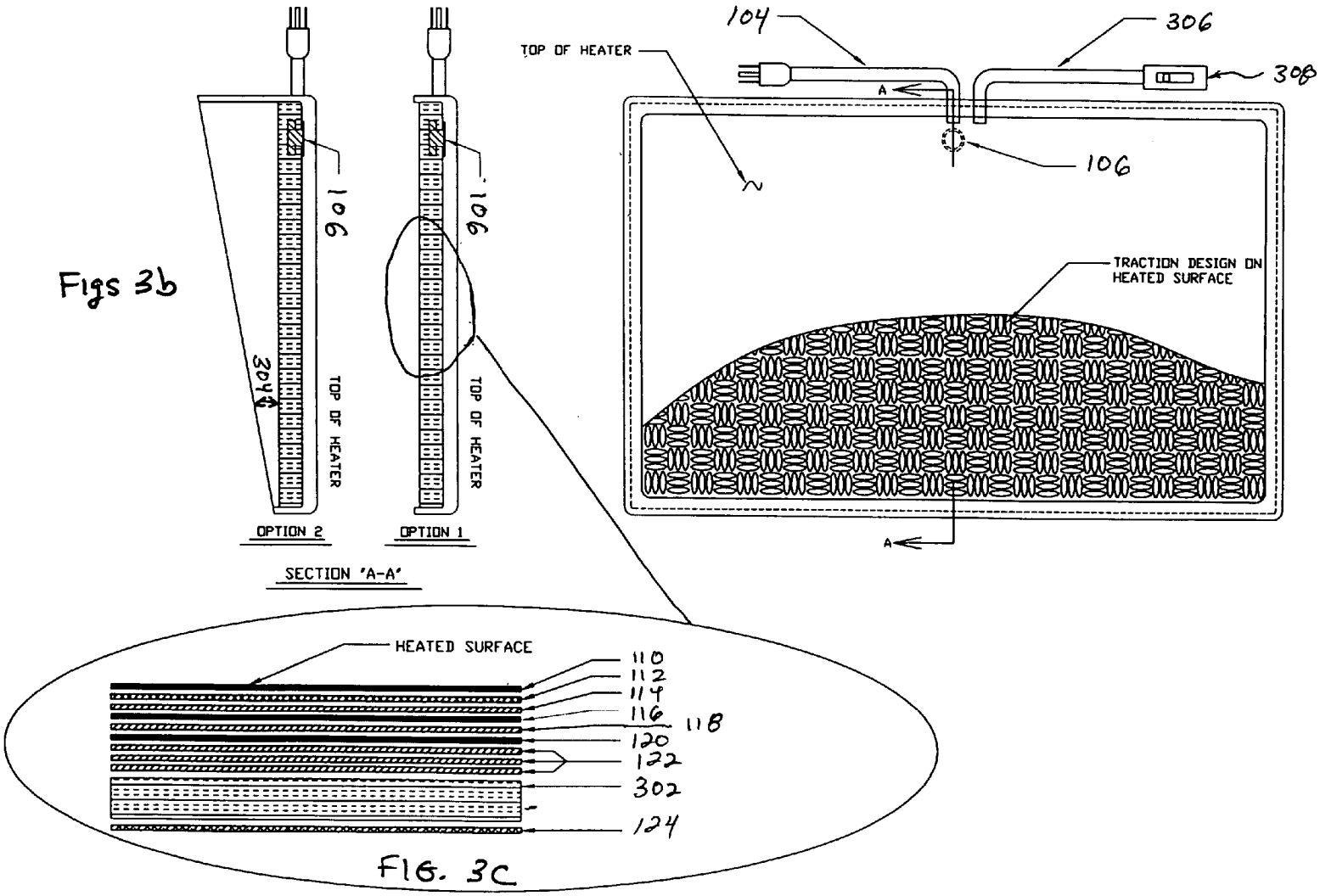
FIG. 3*a* is perspective top surface view showing the overall appearance of the heating mat according to additional embodiments of the invention.
FIGS. 3*b* are side views of the embodiments of the invention depicted in FIG. 3*a;*
FIG. 3*c* is a partially cut-away view of the embodiment of the invention depicted in FIG. 3*a;* and, FIGS. 4*a*–4*c* illustrate how resistance foils are positioned in a series/parallel configuration in the heating mat.

FIGS. 3*a,* 3*b* and 3*c* illustrate further embodiments of the invention in which one or more insulation layers 302 are added near the bottom of the heating mat structure 102. This insulation provides additional protection to the surface on which the heating mat is placed. Further, as depicted in Option 2 of FIG. 3*b,* the top surface of the heating mat is constructed at an angle 304 relative to its bottom surface thereby providing a comfortable foot rest position. Additional embodiments of the invention permit this angle to be readily adjusted by the user, by various well-known methods.

FIG. 3*a* also depicts an additional feature of this embodiment of the invention—the use of a separate connection cord 306 on which is located an adjustable thermostatic control device 308. Use of this feature permits an individual to make use of the heating mat in a location such as under his desk and permit him to conveniently adjust the temperature (and in fact, turn off the heating mat) by use of the control 308 which could be located on top of his desk.

It should be noted that the invention is not limited to the above embodiments. As noted above, the heating mat can be made to various custom sizes. Further, the power output of the heater can be customized for various climatic conditions. Still further, the color of the outer resin can be color coordinated to the surrounding dècor.

Figure 4A:
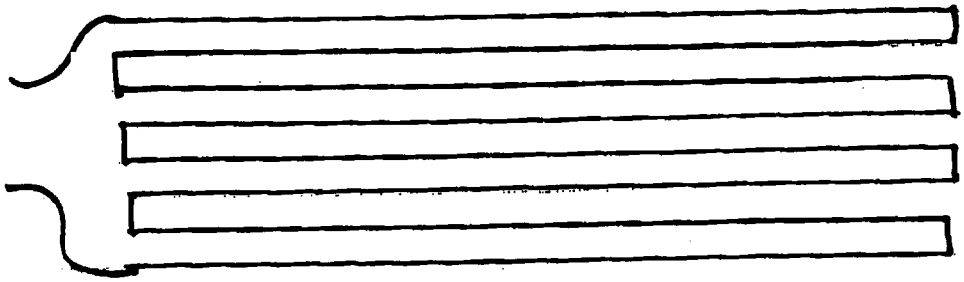
Figure 4B:
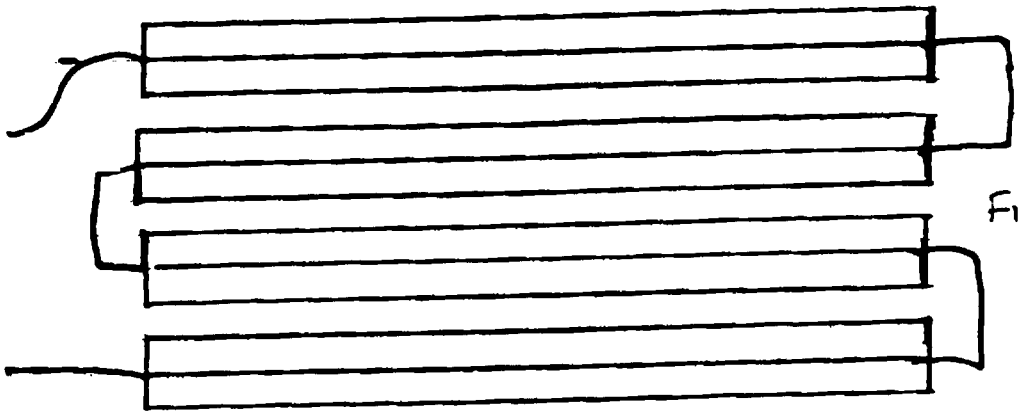
Figure 4C:
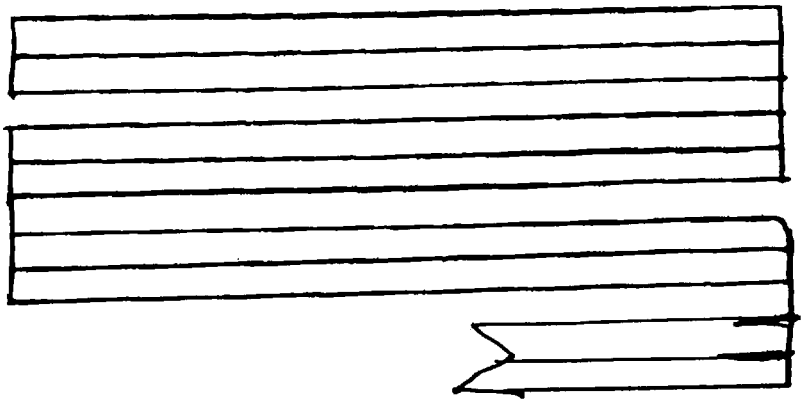

In on embodiment, the method of manufacturing the heating mat comprises the following. A heating blanket is constructed using a resistance foils that are electrically in a series/parallel configuration. An example of such a configuration is depicted in FIG. 4*c*. As an aide in understanding, FIG. 4*a* has been added as a side view illustration of foils in a simple series configuration. FIG. 4*b* is added as a side view illustration of a series/parallel configuration of three foil elements in parallel with "jumpers" used to make series connections (of additional sets of three foil elements). FIG. 4*c* is similar to FIG. 4*b* in that the foils are arranged so that jumpers are not required.

In one embodiment for construction of the heating mat 102 depicted in FIGS. 1*a* and 1*b,* a flexible mold is utilized. The heating mat structure is constructed in this mold with the top layer of the mat first being added. Accordingly, the traction design surface appearing on the top surface of the heating mat structure results from a pattern appearing in the bottom of the mold. Into this mold is poured self-extinguishing grade polyester resin (pigmented to the desired color) and then a surface tissue layer is added. These steps correspond to layers 110 and 112, respectively, of the finished heating mat. Then a layer of roving fiberglass chopped strand matting is added 114. A ground screen 116 of aluminum mesh, or equivalent material, is then laminated in with a covering of fiberglass matting 118. Onto this is applied the heating element 120 and one or more further layers of fiberglass matting 122 and then the final surface color is added, all coagulating together to form a homogeneous panel. As each layer is added, the structure is subjected to a rolling process to prevent any air pockets from forming.

In alternative embodiments a snap acting thermostat 106 is laminated into the heating panel over the heating element to act as a thermal cut-out at elevated temperatures. The thermostat is covered by a small junction box in embodiments similar to the embodiment depicted in FIG. 2*a*. Alternatively, the thermostat is attached to the back of the heating mat in those embodiments similar to the embodiment depicted in F*ig*. 1*a*. The cord leads are mechanically connected to the heating blanket in the laminate. The box is potted with polyester resin and totally seated. When the heating mat has cured, it is removed from the mold, checked for size and all electrical connections are checked for integrity. When all tests have been satisfactorily completed, a label is permanently fixed to the power cord.

It will be understood that the forgoing description of the invention is by way of example only, and variations will be evident to those skilled in the art without departing from the scope of the invention.

What is claimed is:

1. An electrically powered heating mat, said mat having an essential planar structure having a top surface and a bottom surface and comprising:

a heating element, said heating element comprising at least two electrically resistive foil elements, each element constructed of a nichrome material;

an upper chopped strand fiberglass layer positioned adjacent to and above the heating element;

a lower chopped strand fiberglass layer positioned adjacent to and below the heating element;

an aluminum earth screen positioned above the upper chopped strand fiberglass layer, said aluminum earth screen providing ground fault protection to the mat;

a surface tissue positioned above said aluminum earth screen;

a gell coat layer positioned above the surface tissue; and, a flow coat resin layer positioned below the lower chopped strand fiberglass layer.

2. The heating mat of claim 1 in which each of said foil elements has width of not greater than 0.125" and thickness not greater than 0.005".

3. The heating mat of claim 1 in which said nichrome material has an 80/20 ratio of nickel to chrome.

4. The heating mat of claim 1 wherein said gell coat layer and said surface tissue are of different colors thereby providing an indicator when said gell coat layer has been damaged or significantly worn.

5. The heating mat of claim 1 further comprising a thermal cut out switch.

6. The heating mat of claim 1 further comprising an adjustable thermostatic control device, said device mounted on a connection cord remote from said heating mat.

7. The heating mat of claim 1 further comprising at least one insulation layer positioned immediately above the flow coat resin layer.

8. The heating mat of claim 7 wherein the thickness of said mat is approximately 1.25".

9. The heating mat of claim 1 further comprising a rubber padding layer positioned below the flow coat resin layer.

10. The heating mat of claim 1 wherein the thickness of said mat is approximately 0.5".

11. The heating mat of claim 1 further comprising a means for establishing an acute angle between the heating mat and a surface on which it rests.

12. The heating mat of claim 1 wherein the upper chopped strand fiberglass layer and the bottom chopped strand fiberglass layer are sewn together to form at least two protective pockets, wherein a foil element is positioned in each of said pockets.

* * * * *